US009389591B2

(12) United States Patent
Born et al.

(10) Patent No.: US 9,389,591 B2
(45) Date of Patent: Jul. 12, 2016

(54) REGULATING DEVICE

(71) Applicant: The Swatch Group Research and Development Ltd, Marin (CH)

(72) Inventors: Jean-Jacques Born, Morges (CH); Gianni Di Domenico, Neuchatel (CH); Jerome Favre, Neuchatel (CH); Baptiste Hinaux, Lausanne (CH); Dominique Lechot, Reconvilier (CH); Patrick Ragot, Fontainemelon (CH)

(73) Assignee: The Swatch Group Research and Development Ltd, Marin (CH)

( * ) Notice: Subject to any disclaimer, the term of this patent is extended or adjusted under 35 U.S.C. 154(b) by 0 days.

(21) Appl. No.: 14/564,581

(22) Filed: Dec. 9, 2014

(65) Prior Publication Data

US 2015/0177696 A1 Jun. 25, 2015

(30) Foreign Application Priority Data

Dec. 23, 2013 (EP) ..... 13199425

(51) Int. Cl.
*G04C 5/00* (2006.01)
*G04C 3/10* (2006.01)

(52) U.S. Cl.
CPC ..... *G04C 5/005* (2013.01); *G04C 3/105* (2013.01)

(58) Field of Classification Search
CPC ..... G04C 5/005; G04C 5/00; G04C 3/105; G04C 3/004; G04C 3/024; G04C 3/10; G04C 3/06; G04C 3/04; G04C 3/047; G04C 3/107
See application file for complete search history.

(56) References Cited

U.S. PATENT DOCUMENTS

| | | | | |
|---|---|---|---|---|
| 2,750,730 A | | 6/1956 | Kohlhagen | |
| 2,762,222 A | | 9/1956 | Clifford | |
| 3,183,426 A | * | 5/1965 | Haydon | G04C 5/005 368/132 |
| 3,208,287 A | | 9/1965 | Ishikawa et al. | |
| 3,410,083 A | * | 11/1968 | Korr | G04C 5/005 368/126 |
| 3,518,464 A | * | 6/1970 | Ikeno | G04B 11/04 310/22 |
| 3,577,874 A | * | 5/1971 | Mutter | G04C 3/105 310/25 |

(Continued)

FOREIGN PATENT DOCUMENTS

| | | |
|---|---|---|
| FR | 987 840 | 8/1951 |
| GB | 698 406 | 10/1953 |
| GB | 838 430 | 6/1960 |

OTHER PUBLICATIONS

European Search Report issued Aug. 6, 2014 in European Application 13199425, filed on Dec. 23, 2013 ( with English Translation).

*Primary Examiner* — Amy Cohen Johnson
*Assistant Examiner* — Matthew Powell
(74) *Attorney, Agent, or Firm* — Oblon, McClelland, Maier & Neustadt, L.L.P.

(57) ABSTRACT

The invention concerns a magnetic device for regulating the relative angular velocity of a wheel and of at least one magnetic dipole integral with an oscillating device. The wheel or the dipole is driven by a driving torque. The wheel includes a periodic, ferromagnetic pole path which alternates according to a center angle and the at least one dipole is arranged to permit magnetic coupling with the ferromagnetic path and oscillation of the dipole at the natural frequency of the oscillating element during the relative motion of the wheel and of the magnetic dipole to regulate the relative angular velocity. The wheel further includes an assembly to dissipate the kinetic energy of the at least one dipole when it moves away from the ferromagnetic path.

21 Claims, 9 Drawing Sheets

(56) References Cited

U.S. PATENT DOCUMENTS 3,609,958 A * 10/1971 Bertsch ..... G04C 5/005 310/37
3,671,825 A * 6/1972 Allison ..... H02K 7/065 310/22
3,675,055 A * 7/1972 McShan ..... G04B 11/04 310/22
3,690,191 A * 9/1972 Ott ..... F16H 31/00 310/21
3,694,681 A * 9/1972 Horstmann ..... G04C 3/00 310/21
3,813,871 A * 6/1974 Hirose ..... G04C 5/005 368/126
3,864,586 A * 2/1975 Saito ..... G04C 3/10 310/21

* cited by examiner

Cm1
Cv1
Ca1
t / s
0
5
10
15
20
25
30
150
100
50
0
$M_E(t)$ / μNm
100
10
1
0.1
θ'(t) / rad/s
Without eddy current brake: uncoupling.
10
5
0
−5
−10
x(t) / mm Cm2
t / s
0
5
10
15
20
25
30
150
100
50
0
$M_E(t)$ / μNm
Cv2

100
10
1
0.1
θ'(t) / rad/s
Without eddy current brake:
synchronization.

10
5
0
−5
−10
x(t) / mm
Ca2
0
5
10
15
20
25
30
t / s

REGULATING DEVICE

This application claims priority from European Patent Application No. 13199425.3 filed Dec. 23, 2013, the entire disclosure of which is hereby incorporated herein by reference.

FIELD OF THE INVENTION

The present invention concerns the technical field of magnetic devices for regulating the relative angular velocity of a wheel and at least one magnetic dipole integral with an oscillating element and, in particular, regulating devices of this type for use in the watch industry, especially in wristwatches.

The present invention also concerns a timepiece movement equipped with such a regulating device and a timepiece, especially, but not exclusively, a wristwatch provided with a timepiece movement of this type.

BACKGROUND OF THE INVENTION

Numerous magnetic regulating devices of this type have been proposed in the prior art. U.S. Pat. No. 2,762,222, which discloses such a regulating device, may be cited by way of example.

FIGS. 1 and 2 show schematic views of a typical prior art regulating device wherein a resonant structure 1, having a general "C" shape, carries a fixed permanent magnet 2 so that the two free ends of the "C" form two magnetic poles 8 and 10, thereby delimiting an air gap E. Magnet 2 is fixed to the base of the "C" via an elastic structure 4, which is fixed in turn to a frame B by screws 6. An escape wheel 12, made of a material of high magnetic permeability, is arranged such that its teeth 12*a* pass into air gap E. Each tooth 12*a* of wheel 12 is hollowed to form a ferromagnetic path 14 of sinusoidal shape. Wheel 12 is driven in rotation by a driving torque, symbolised by the arrow C, derived from a barrel which is not shown. When escape wheel 12 turns, the magnetic poles 8, 10 of the resonator 1, tend to follow the sinusoidal ferromagnetic path 14 defined by escape wheel 12. In doing so, resonator 1 starts to vibrate in the radial direction R of escape wheel 12 until it reaches its natural frequency in steady state. With an ideal resonator, this natural frequency is substantially independent of the driving torque. The resonator is maintained by the transmission of energy from the escape wheel 12 driven by the barrel. The velocity of escape wheel 12 is thus synchronised with the natural frequency of oscillator 1.

To date, magnetic escapements of this type have not been integrated in wristwatches due their high shock sensitivity. Indeed, in the event of shocks, the oscillating structure or the oscillating magnet may move away from the ferromagnetic path and break the magnetic coupling between the oscillating structure and said path. In that case, the escape wheel is driven by the driving torque in an uncontrolled manner. Two situations may arise depending on the nature of the shock. Either, when there is a shock, the escape wheel jumps one or more step and then synchronises again with the oscillating structure, which leads to a loss of state impairing the chronometric performance of the watch. Or, the intensity and/or duration of the shock are such that the magnetic coupling between the wheel and the oscillating structure is permanently lost, this phenomenon is generally denoted by the term "uncoupling". The oscillating structure then stops oscillating and the escape wheel is driven in rotation in an uncontrolled manner until the mainspring barrel is totally let down.

To overcome this problem, a first solution has been proposed consisting in strengthening the magnetic coupling between the escape wheel and the oscillating structure, for example, by reducing to a minimum the distance between the magnetic poles and the wheel. However, this solution is not entirely satisfactory in that it limits the possibilities of the wheel self-starting or presents problems of locking caused by the poles sticking on the escape wheel.

A second attempt to overcome this problem consisted in providing a plurality of mechanical stop members arranged on either side of the ferromagnetic path against which the oscillating magnet abuts as soon it moves away from its coupling path. Although this device can prevent the uncoupling of the escape wheel, it increases the size of the system and induces perturbations in the oscillating structure with every shock against the stop members, resulting in decreased chronometric performance in a similar manner to the problem of knocking in a conventional Swiss lever escapement.

It is therefore a main object of the invention to overcome the drawbacks of the aforecited prior art by providing a magnetic device for regulating the relative angular velocity of a wheel and of an oscillating structure of the type described above, including means intended to reduce or eliminate shock sensitivity (hereafter denoted as "anti-uncoupling means").

It is also an object of the invention to supply a regulating device of this type wherein the anti-uncoupling means do not use energy derived from the barrel in normal operation.

It is also an object of the invention to provide a regulating device of this type wherein the anti-uncoupling means do not adversely affect the self-starting of the system.

It is also an object of the invention to provide a regulating device of this type wherein the anti-uncoupling means do not cause any friction and consequently any wear, dust or noise.

It is also an object of the invention to provide a regulating device of this type wherein the anti-uncoupling means do not increase the size of the device.

It is also an object of the invention to provide a regulating device of this type wherein the anti-uncoupling means are reliable, economical and easy to implement.

SUMMARY OF THE INVENTION

To this end, the invention concerns a magnetic device for regulating the relative angular velocity of a wheel and of at least one magnetic dipole integral with an oscillating device, said wheel or said dipole being driven by a motor torque, said wheel including a periodic, ferromagnetic pole path which alternates according to a central angle? and said at least one dipole being arranged to permit magnetic coupling with said ferromagnetic path and oscillation of said dipole at the natural frequency of the oscillating element during the relative motion of the wheel and of the magnetic dipole to regulate said relative angular velocity, said device being characterized in that said wheel further includes means for dissipating the kinetic energy of said at least one dipole when it moves away from said ferromagnetic path.

Thus, at the moment when the magnetic dipole tends to move away from the ferromagnetic path as a result of the acquisition of surplus kinetic energy, for example following a shock, the dissipation means of the present invention immediately dissipate said surplus energy and are intended to return the kinetic energy of the oscillating dipole to a level permitting the coupling thereof with said ferromagnetic path. This, on the one hand, limits the disruptive effects on chronometry resulting from uncoupling and, on the other hand, eliminates the risk of permanently losing the coupling between the oscillating dipole and the wheel after uncoupling.

It will also be specified that, within the scope of the invention, "magnetic dipole" refers to any means, of any form, producing a permanent magnetic field, that is to say the dipole could be formed by any type of permanent magnet or electromagnet.

Preferably, the kinetic energy dissipation means are arranged adjacent to said ferromagnetic path on at least one of the sides of said ferromagnetic path.

According to an advantageous embodiment of the invention, the kinetic energy dissipation means include non-ferromagnetic, electrical conductive sectors extending substantially in the plane of said ferromagnetic path and disposed on both sides of said ferromagnetic path. These sectors are preferably made of a material chosen from the group including gold, silver, copper, aluminium, platinum, palladium, titanium and nickel.

When the dipole leaves the ferromagnetic path subsequent to a shock, it is in motion facing non-ferromagnetic, electrically conductive sectors generating eddy currents in the sectors "overflown" by the dipole and which immediately oppose the movement of the dipole and tend to bring the oscillating dipole back to the ferromagnetic path and to re-establish magnetic coupling therewith.

Preferably, the non-ferromagnetic, electrically conductive sectors are electrically insulated from said ferromagnetic path, typically by an air gap or any other means of galvanic insulation.

This galvanic insulation makes it possible to reduce or remove any undesirable stray eddy currents which would appear in normal operation, especially when the dipole moves close to the edge of the ferromagnetic path.

Advantageously, the ferromagnetic path includes through slots extending substantially perpendicularly to the plane of the ferromagnetic path and/or the ferromagnetic path is formed by a concentric lamination of ferromagnetic material.

As a result of these characteristics, any undesirable stray eddy induction currents which would appear in normal operation in the ferromagnetic path are prevented, reduced or eliminated.

It is therefore understood that the eddy currents appearing in the non-ferromagnetic, electrically conductive sectors extending substantially in the plane of said ferromagnetic path and arranged on both sides of said ferromagnetic path, are desired eddy currents which contribute to the dissipation of kinetic energy in the dipole when the latter oscillates with an amplitude moving it away from the ferromagnetic path, whereas any eddy currents induced in the ferromagnetic path are undesirable stray eddy currents that it is desired to remove or at least reduce to a minimum.

According to an embodiment of the invention, the wheel includes an insulating substrate on at least one face of which are arranged the ferromagnetic path and the non-ferromagnetic, electrically conductive sectors.

According to a preferred configuration of the magnetic regulating device according to the invention, the magnetic dipole is a permanent magnet whose direction of magnetisation is perpendicular to the plane of the ferromagnetic path. The permanent magnet is comprised in an open structure defining a closed magnetic circuit and an air gap in which the wheel can move perpendicularly to the direction of magnetic flux generated by the magnet, the free ends of said structure extending substantially facing said ferromagnetic path when said oscillating element is at rest, the wheel being driven by the driving torque and the oscillating element is integral with a fixed frame.

DESCRIPTION OF THE DRAWINGS

The invention will be better understood upon reading the following description of a particular embodiment, provided by way of non-limiting illustration, and illustrated by means of the annexed drawings, in which.

DETAILED DESCRIPTION OF PARTICULAR EMBODIMENTS

Figure 1:
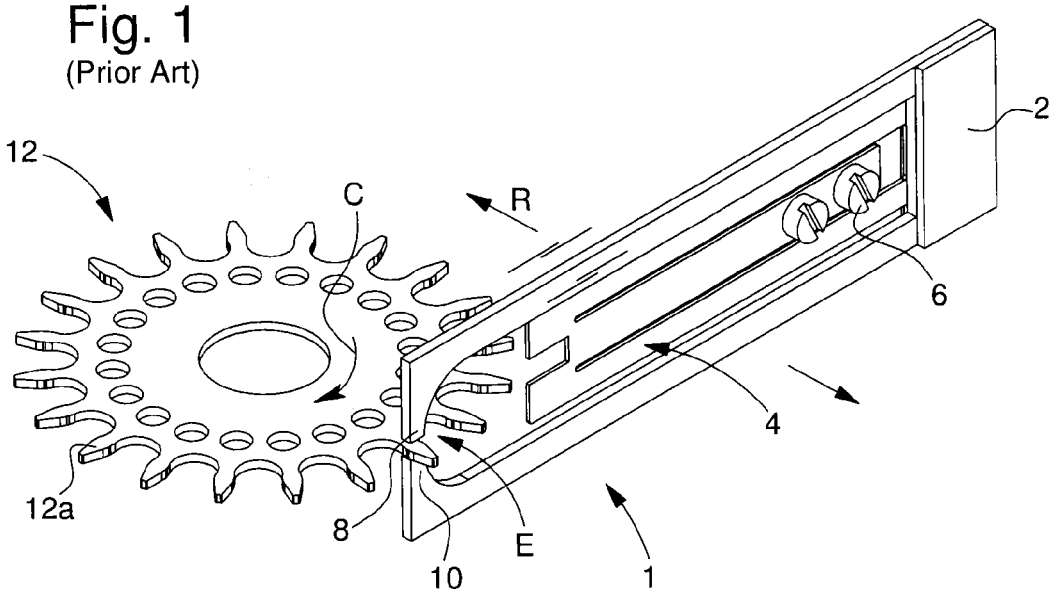
Fig. 1 (Prior Art)
FIGS. 1 and 2 show schematic, simplified, respectively perspective and top views of a magnetic device for regulating the angular velocity of a Clifford escape wheel according to the prior art.
Figure 2:
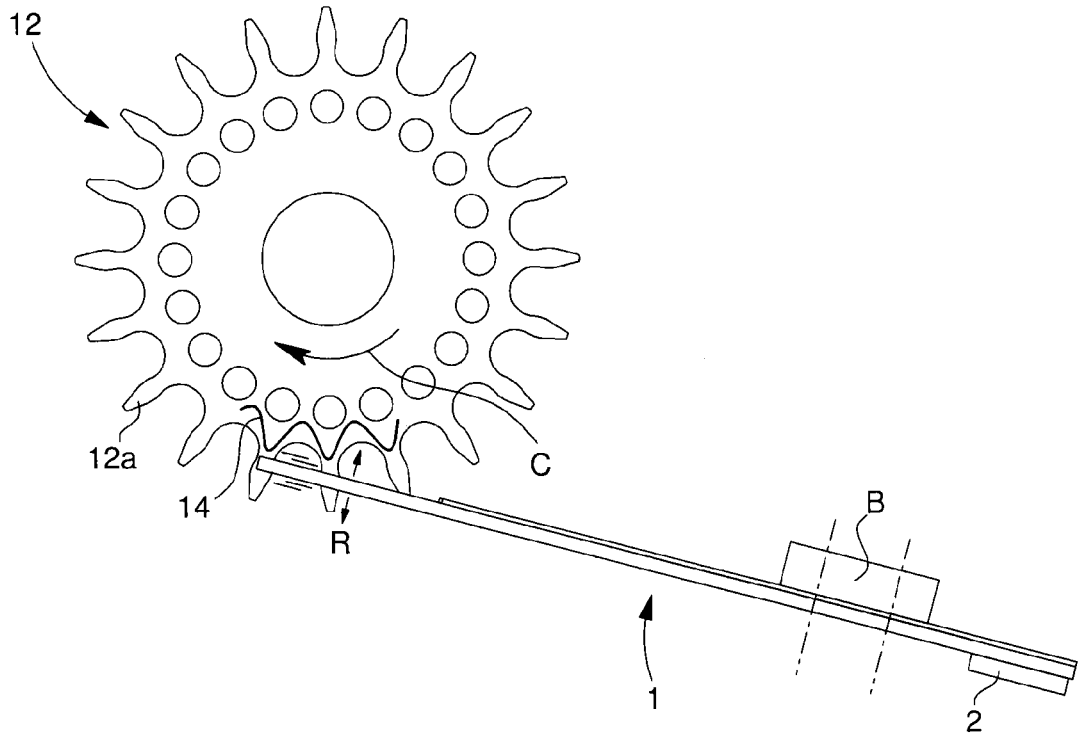
Fig. 2 (Prior Art)
Figure 3A:
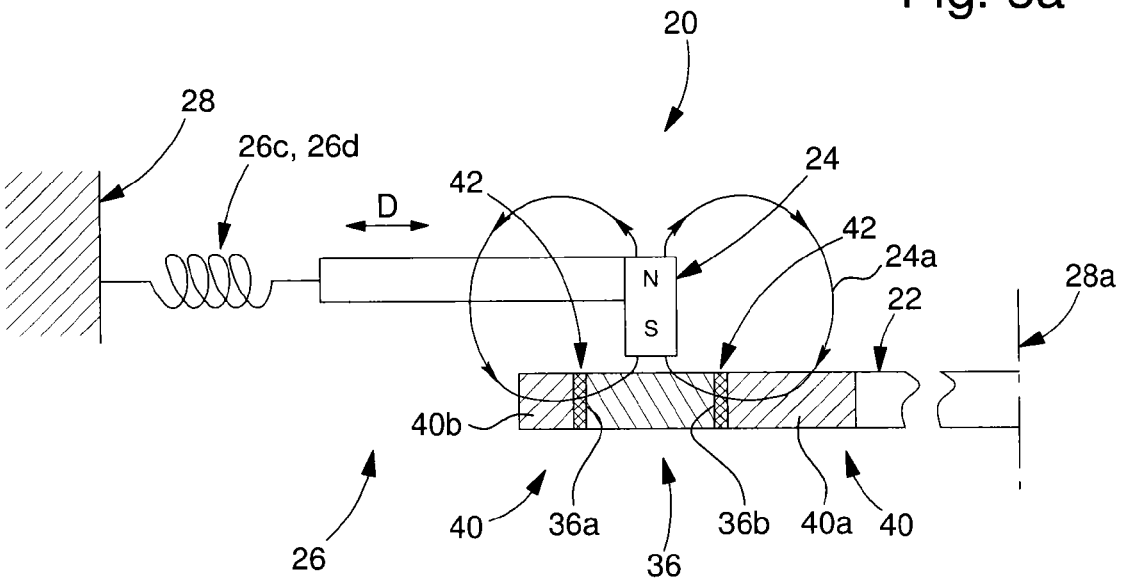
FIG. 3*a* is a schematic cross-section of a first configuration of a magnetic regulating device according to the invention illustrating the means for dissipating the kinetic energy of the oscillating dipole and wherein the magnetic dipole is arranged on only one side of the ferromagnetic path.
Figure 3B:
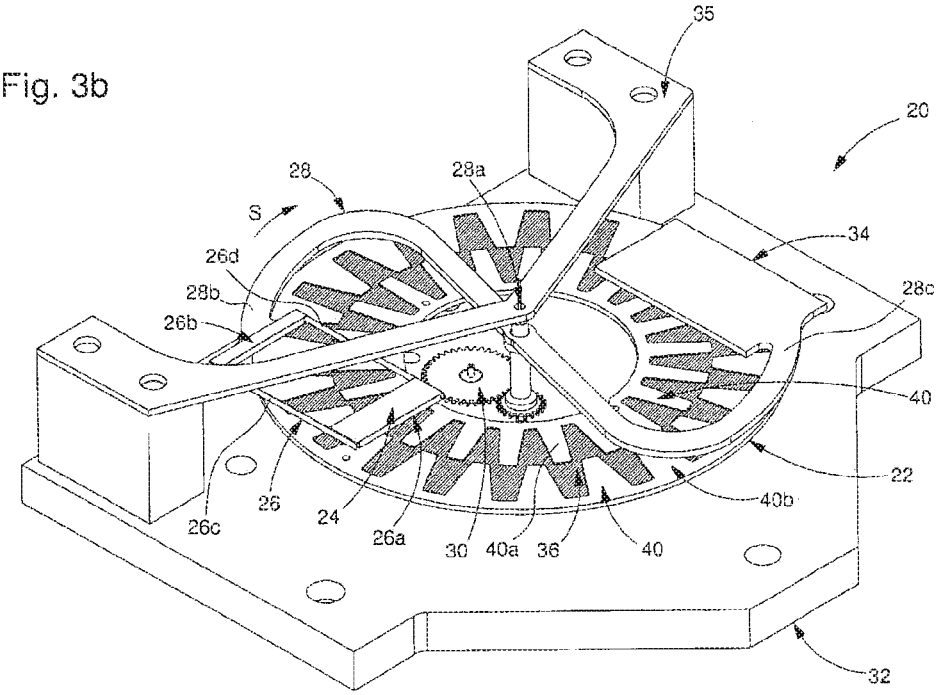
FIGS. 3*b* and 3*c* respectively show perspective and top views of an example embodiment of the magnetic regulating device shown in FIG. 3*a*, wherein the magnetic dipole is arranged on a rotor and the magnetic path is fixed.
Figure 3C:
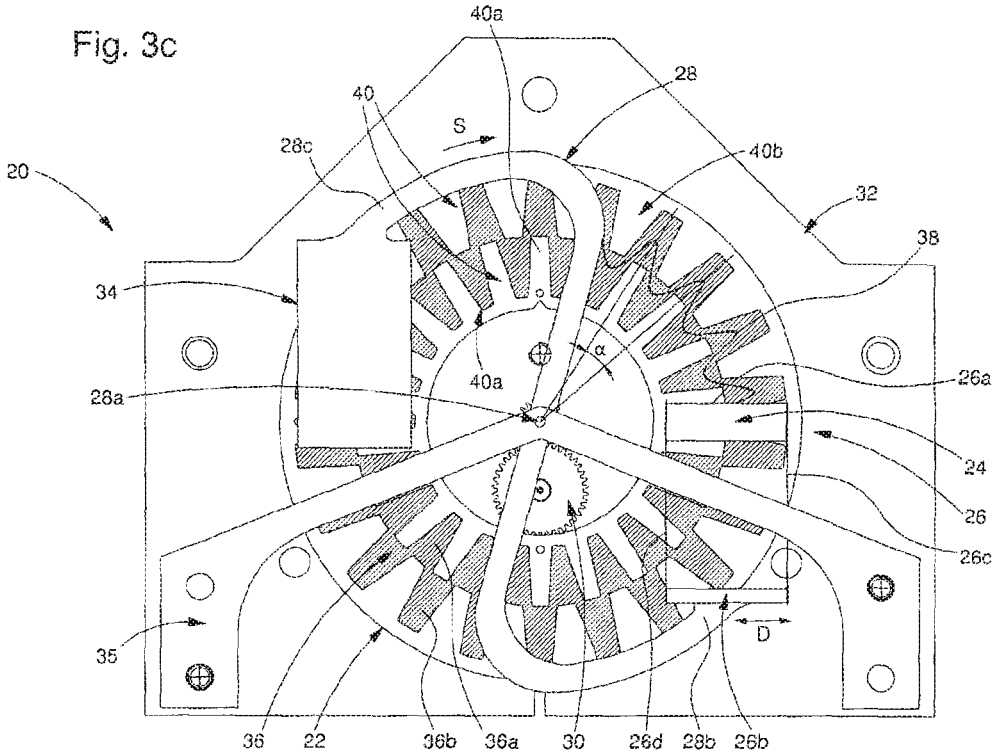

Referring to FIGS. 3*a* to 3*c*, there is shown a first example embodiment of a magnetic regulating device according to the invention denoted by the general reference 20. FIG. 3*a* shows a schematic, simplified cross-section of the principle implemented in the example embodiment shown in FIGS. 3*b* and 3*c*. In the following description, identical elements are denoted by the same reference numerals.

Device 20 makes it possible to regulate the relative angular velocity of a wheel 22 and of a magnetic dipole, formed in this example by a permanent magnet 24, typically made of a neodymium, iron, and boron alloy. Magnet 24 is integral with an oscillating element 26, which is integral in turn with a rotor 28 rotating about an axis 28*a* and driven by a driving torque derived from a barrel (not shown) via a conventional going train with a predefined gear reduction ratio and of which only one wheel set 30 is shown in FIGS. 3*b* and 3*c*. Through this kinematic connection, rotor 29 is subjected to a permanent torque tending to rotate it in a predefined direction of rotation, symbolised by the arrow S in the drawing. Wheel 22 is integral with a flame 32, for example a main plate of a timepiece movement, and rotor 28 is mounted for rotation coaxially to wheel 22 on axis 28*a* between frame 32 and a bridge 35 (FIGS. 3*b* and 3*c*). Rotor 28 is arranged so that oscillating element 26 is rotatable above wheel 22. In this example embodiment, wheel 22 is fixed.

In the illustrated example, rotor 28 is in the shape of an "S", one end 28*b* of which carries oscillating element 26 and the other end 28*c* of which carries a counterweight 34 taking the form of a plate of suitable dimensions. Oscillating element 26 takes the general form of a frame including two opposite rigid posts 26*a*, 26*b* and two flexible posts 26*c*, 26*d* (symbolised by a spring in FIG. 3*a*). Oscillating element 26 is fixed to rotor 28 by its rigid post 26*b* and permanent magnet 24 is fixed to the opposite rigid post 26*a*. Owing to the elasticity of flexible posts 26*c* and 26*d*, magnet 24 integral with post 26*a* can oscillate in the plane formed by frame 26*a*, 26*b*, 26*c* and 26*d* in direction D. It will be noted in this regard that the posts of the frame are sized to prevent any elastic deformation outside the plane of frame 26, which forms an oscillating structure in a plane parallel to the plane of wheel 22.

Wheel 22 includes a periodic, ferromagnetic pole path 36 which alternates according to a center angle aligned on axis 28*a* (FIG. 3*c*). Magnet 24 is sized and arranged to permit, on the one hand, magnetic coupling with ferromagnetic path 36 and, on the other hand, the oscillation of magnet 24 in the plane of frame 26 at the natural frequency of oscillating element 26 during rotation of rotor 28.

The shape of ferromagnetic path 36 is devised to maintain a trajectory 38 of magnet 24 having a substantially sinusoidal shape closed on itself within the fixed reference of the frame. In this example, magnet 24 is arranged on only one side of the ferromagnetic path 36 comprised in wheel 22. Magnet 24 has a direction of magnetisation perpendicular to the plane of ferromagnetic path 36 as is particularly well illustrated in FIG. 3*a*. Magnet 24 is thus arranged in an "open" magnetic circuit in the sense that field lines 24*a* are closed outside magnet 24 passing through layers of air external to said magnet and therefore without being guided.

Ferromagnetic path 36 is typically made of a material chosen from the group including soft iron, mu-metal or Supermalloy including nickel (75%), iron (20%), and molybdenum (5%). Ferromagnetic path 36 is typically cut into a plate made of one of these materials to define a ring including inner crenellations 36*a* and outer crenellations 36*b* each forming teeth of trapezoidal shape.

Regulating device 20 further includes means 40 for dissipating the kinetic energy of oscillating magnet 24 arranged adjacent to ferromagnetic path 36 on both sides thereof and in substantially the same plane, i.e. in the plane of ring 36 forming ferromagnetic path 36.

In the illustrated example, the kinetic energy dissipation means 40 include non-ferromagnetic, electrically conductive sectors typically made in the form of two rings 40*a* and 40*b* respectively interleaved inside and outside the ring forming ferromagnetic path 36. These sectors 40 are typically cut into a plate made of a material chosen from the group including gold, silver, copper, aluminium, platinum, palladium, titanium or nickel.

These non-ferromagnetic, electrically conductive sectors 40 are electrically insulated from ferromagnetic path 36 by means of an air gap or galvanic means 42 (FIG. 3*a*). Insulation means 42 are arranged on both sides of lateral walls 36*a* 36*b* of ferromagnetic path 36. Typically, when insulation means 42 are not simply an air filled space, a polymer resin or insulating varnish is provided.

Figure 4:
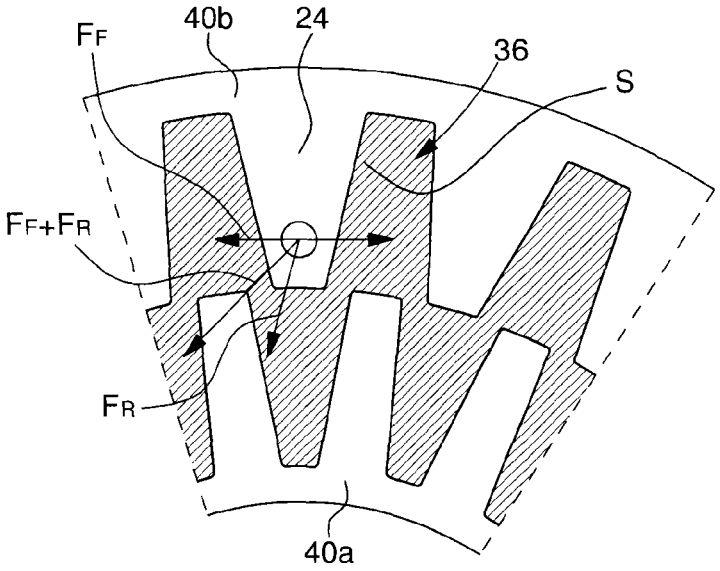
FIG. 4 illustrates the forces applied to the magnetic dipole when it has momentarily left the ferromagnetic path with the kinetic energy dissipation means according to the invention.

FIG. 4 shows the forces being applied to magnet 24 when it has momentarily left ferromagnetic path 36, for example subsequent to a shock, and is above a non-ferromagnetic, electrically conductive sector 40*a* or 40*b*. It is seen that magnet 24 is subjected to a force $F_F$ resulting from the eddy currents appearing in the sectors 40*b* "overflown" by magnet 24 and which oppose the direction of movement S) of magnet 24 and which, combined with the return force $F_R$ of flexible posts 26*c*, 26*d*, tend to return magnet 24 to face magnetic path 36 according to the resultant force $F_F+F_R$. Simultaneously, each time magnet 24 passes above a sector 40*a* or 4*b*, a surplus quantity of kinetic energy which caused magnet 24 to leave trajectory 38 is dissipated by Joule effect in the "overflown" sector in which eddy currents have been generated.

FIGS. 5*a* to 5*c* and 5*d* to 5*f* are graphs showing, as a function of time, dynamic simulation of the effect of an abrupt increase in the driving torque (curves $C_{m1}$ and $C_{m2}$) on the rotational velocity of the rotor (curves $C_{v1}$ and $C_{v2}$) and on the amplitude of oscillation of the resulting oscillating magnetic dipole (curves $C_{a1}$ and $C_{a2}$), respectively for a prior art magnetic regulating device (without means for dissipating the kinetic energy of the magnet when it moves away from the ferromagnetic path) and for a magnetic regulating device 20 according to the invention.

Figures 5A, 5B, 5C:
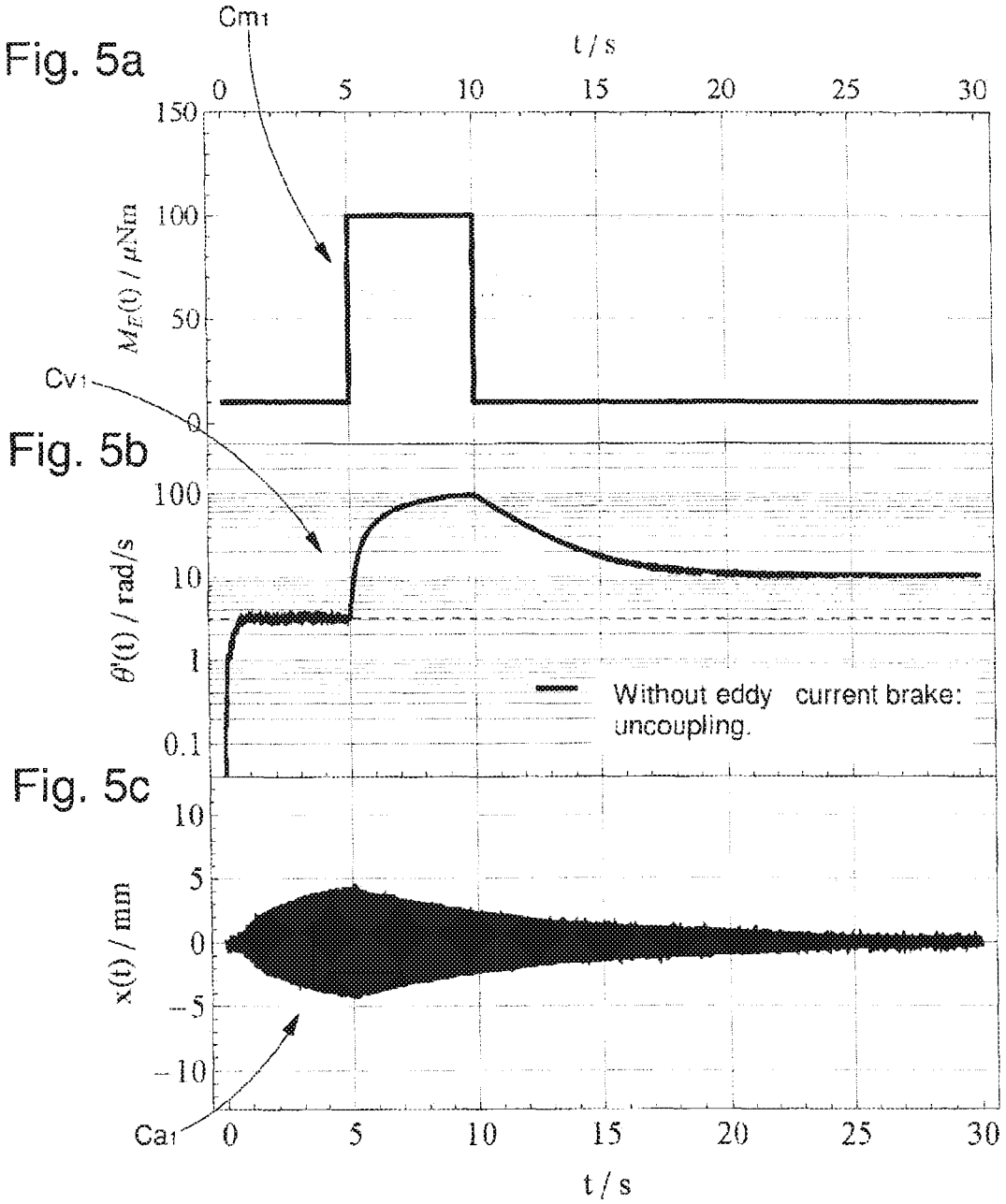
FIGS. 5*a*-5*c* and 5*d*-5*f* show graphs showing, as a function time, dynamic simulation of the effect of an abrupt increase in driving torque on the rotational speed of the rotor and on the resulting amplitude of the oscillating magnetic dipole, respectively for a prior art magnetic regulating device and a magnetic regulating device according to the invention.
Figures 5D, 5E, 5F:
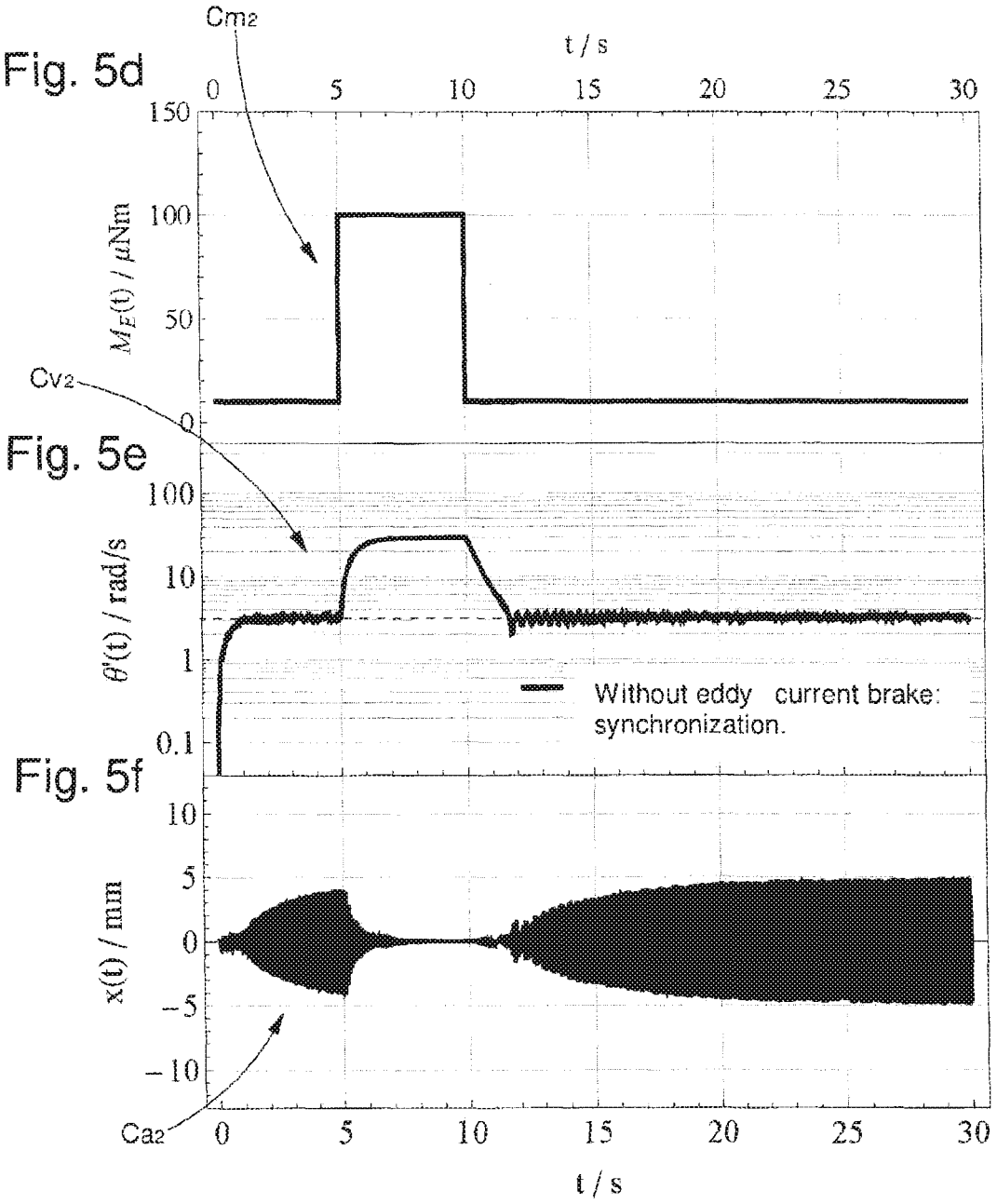

The two curves $C_{m1}$ and $C_{m2}$ illustrated in FIGS. 5*a* and 5*d* show an identical initial driving torque followed by the same increase in driving torque in rotor 28. The duration of this increase is 5 seconds to illustrate the dynamics of the resulting phenomenon.

Two identical initial behaviours are noted in FIGS. 5*b* and 5*e*, namely a stabilised rotational velocity of 3 rads per second followed by different behaviours depending on whether device 20 is equipped (curve $C_{v2}$) or not (curve $C_{v1}$) with means 30 for dissipating the kinetic energy of magnet 24 when it moves away from its ferromagnetic path 36. Indeed, in the absence of the dissipation means (curve $C_{v1}$) it is noted, on the one hand, that the rotational velocity of rotor 28 rapidly increases to a much higher velocity (100 rads per second) than with the means of the invention (30 rads per second $C_{v2}$) and, on the other hand, especially the fact that after the motor torque has returned to its initial value, the rotational velocity of the rotor stabilises at a different value, higher than the initial rotational velocity (10 rads per second) with the prior art device, whereas the rotational velocity of the rotor returns and stabilises at the initial rotational velocity (3 rads per second $C_{v2}$) with the device of the invention.

Finally, it is also noted from curve $C_{a1}$ of FIG. 5*c* that, without the means of the invention, the amplitude of oscillation of the oscillating element decreases from when the increase in driving torque appears towards a zero amplitude, which demonstrates that the oscillating element is permanently uncoupled. Conversely, from curve $C_{a2}$ of FIG. 5*f*, it is seen that, with the means of the invention, when the increase in torque appears, the amplitude decreases towards zero (since the surplus energy is dissipated by Joule effect) and that, at the end of the increase in torque, the amplitude returns to its initial level which demonstrates that the oscillating element is again coupled to the magnetic path.

Figure 6:
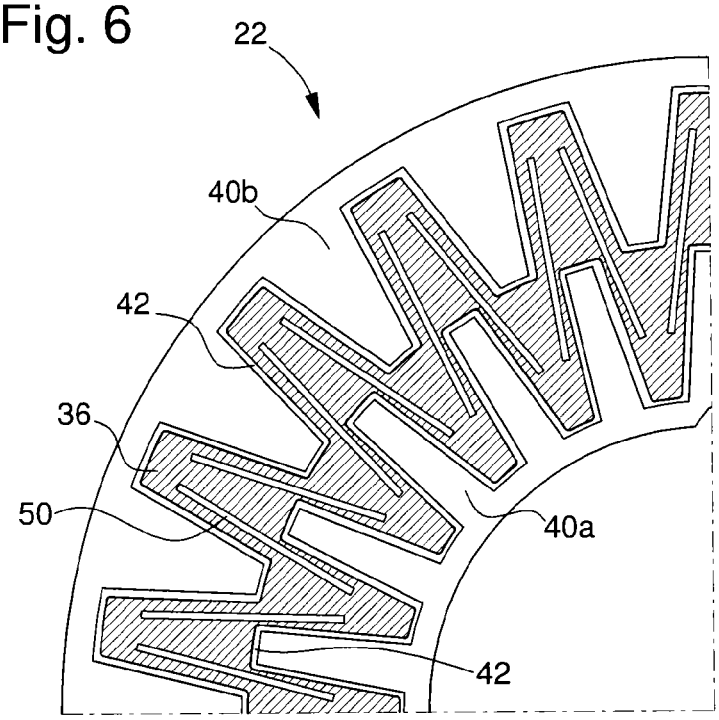
FIGS. 6 and 7*a* are partial top views of two variant embodiments of a ferromagnetic path including means of reducing eddy currents therein associated with kinetic energy dissipation means able to be fitted to a regulating device according to the invention.

FIG. 6 shows a partial top view of a first variant embodiment of a ferromagnetic path 36 able to be fitted to a magnetic regulating device 20 according to the invention. According to this variant, the ferromagnetic path 36 includes means of reducing the undesired stray eddy currents. These means for reducing eddy currents are made in the form of a plurality of slots 50 regularly distributed along ferromagnetic path 36. Slots 50 pass through the entire thickness of ferromagnetic path 36 and preferably extend substantially perpendicularly to the plane of ferromagnetic path 36. In the illustrated example and for reasons of convenience, the longitudinal dimension of slots 50 extends substantially radially, but it goes without saying that the longitudinal dimension of slots 50 could be oriented differently provided the arrangement can reduce induced stray eddy currents in ferromagnetic path 36 in normal operation of the regulating device, i.e. when magnet 24 is oscillating facing magnetic path 36 and follows said path. It will be noted that, advantageously, when ferromagnetic path 36 is formed of a ring cut from a plate as previously described, slots 50 may typically be cut simultaneously with the cutting of the inner and outer shape of the ring by means of a stamping tool of suitable shape.

Figure 7B:
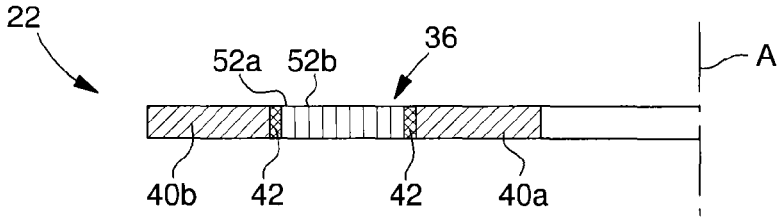
FIG. 7*b* is a cross-section along the line VI-VI of FIG. 7*a* showing, in particular, means of galvanic insulation between the energy dissipation means and the ferromagnetic path of the magnetic regulating device according to the invention.
Figure 7A:
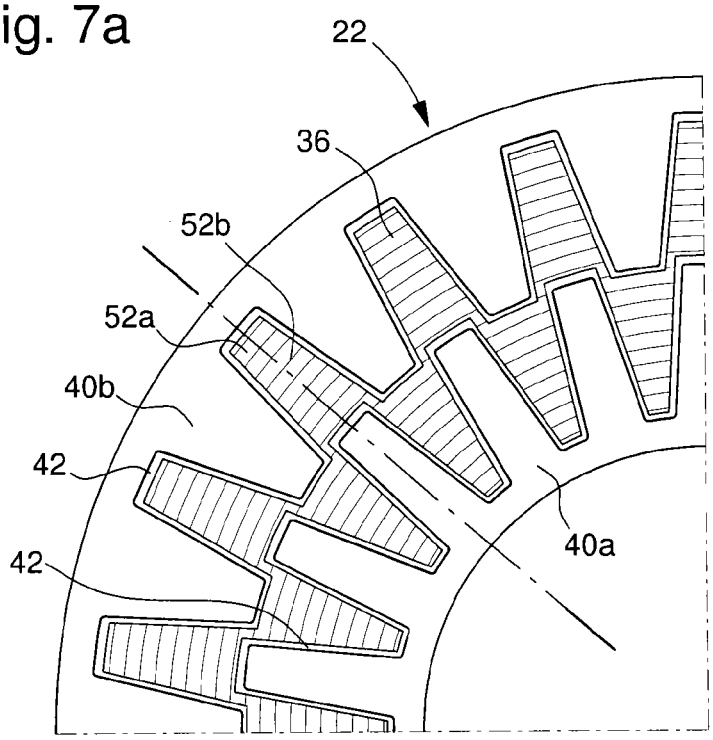

FIGS. 7*a* and 7*b* respectively show a partial top view and cross-section of a second variant embodiment of a ferromagnetic path 36 able to be fitted to a magnetic regulating device 20 according to the invention. In this variant, ferromagnetic path 36 is made in the form of a laminated ring formed of a plurality of layers of ferromagnetic material insulated from each other and extending concentrically about a geometric axis A (FIG. 7*b*) perpendicular to the plane of ferromagnetic path 36. The electrical insulator 52*a* disposed between each layer 52*b* makes it possible to limit the flow of current from one layer to another and thereby reduces losses through undesired eddy currents.

According to yet another variant that is not shown, magnetic path 36 may be made in the form of a laminated ring of the type described with reference to FIGS. 7*a* and 7*b*, further including slots, as described with reference to FIG. 6.

Figure 8:
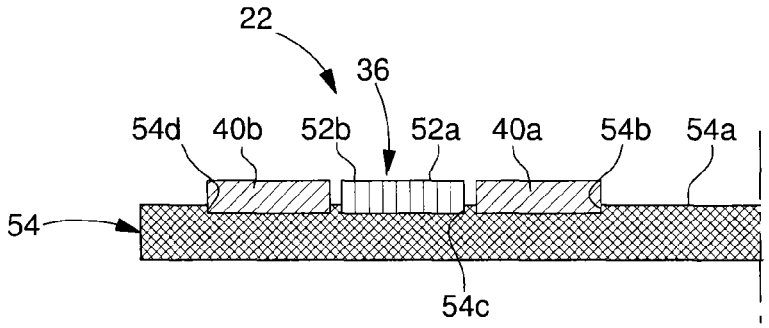
FIG. 8 is a cross-section of an embodiment of a ferromagnetic path associated with kinetic energy dissipation means of a magnetic regulating device according to the invention.

According to one embodiment, ferromagnetic path 36 may be made in one-piece with wheel 22, for example as is shown in FIGS. 6 and 7*a*, 7*b*, but it goes without saying that ferromagnetic path 36 may be affixed to wheel 22 as illustrated, by way of example, in FIG. 8. In this latter case, wheel 22 includes an insulating substrate 54, for example made of plastic, to one face 54*a* of which are affixed ferromagnetic path 36 and the inner 40*a* and outer 40*b* non-ferromagnetic, electrically insulating sectors. Preferably, concentric recesses 54*b*, 54*c* and 54*d*, radially remote from each other and of suitable shapes, are arranged in the surface 54*a* of insulating substrate 54 so as to receive and position in an appropriate manner respectively the inner 40*a* non-ferromagnetic, electrically conductive sector, ferromagnetic path 36 and outer non-ferromagnetic, electrically conductive sector 40*b*. Elements 40*a*, 40*b* and 36 are held in recesses 54*b*, 54*c* and 54*d*, for example, by adhesive bonding or driving in or any other suitable means. The radial distance between circular recesses 54*b*, 54*c* and 54*d* defines an air gap which advantageously allows for galvanic insulation to be formed between magnetic path 36 and the inner 40*a* and outer 40*b* non-ferromagnetic, electrically conductive sectors.

According to a variant which is not shown, it is possible to arrange a ferromagnetic path 36 and inner 40*a* and outer 40*b* non-ferromagnetic, electrically conductive sectors on both surfaces of substrate 54, these elements being arranged in correspondence with each other. In such case, a permanent oscillating magnet 24 will be coupled to each of the ferromagnetic paths.

Figure 9A:
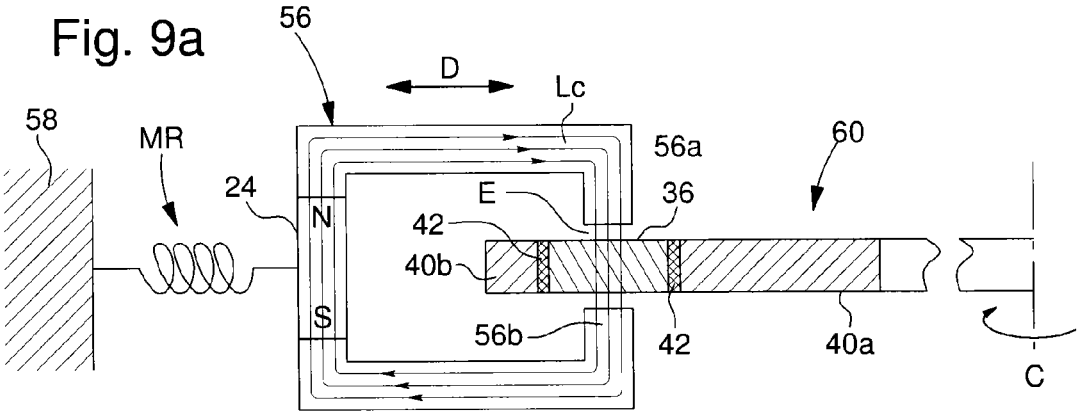
FIG. 9*a* is a schematic cross-section of a second configuration of a magnetic regulating device according to the invention, wherein a permanent magnet is arranged in a closed magnetic circuit and wherein the oscillating magnetic dipole is connected to a fixed frame and the magnetic path is integral with a rotor.

FIG. 9*a* shows a second configuration of a magnetic regulating device 20 according to the invention wherein the permanent magnet 24, oscillating in the direction symbolised by arrow D, is arranged in a magnetic circuit formed by a conductive frame 56, for example made of soft iron, and having a "C" shape, along which the magnet is integrated. In this configuration, oscillating magnet 24 is connected to a fixed frame 58 via return means MR and magnetic path 36 is integral with a rotor 60 driven in rotation by a motor torque C derived from a barrel via a conventional going train (not shown). Rotor 60 has an identical structure to wheel 22 described with reference to the preceding Figures. Wheel 22 moves inside air gap E delimited by the free ends of the branches of the "C". Ferromagnetic path 36 carried by wheel 60 extends perpendicularly to the direction of magnetic flux generated by magnet 24. The free ends 56*a*, 56*b* of frame 56 are arranged substantially facing ferromagnetic path 36 when oscillating magnet 24 is at rest. The field lines $L_c$ are thus guided inside the frame to above magnetic path 36 and are closed in passing therethrough so that the magnetic coupling of oscillating magnet 24 is improved.

Figure 9B:
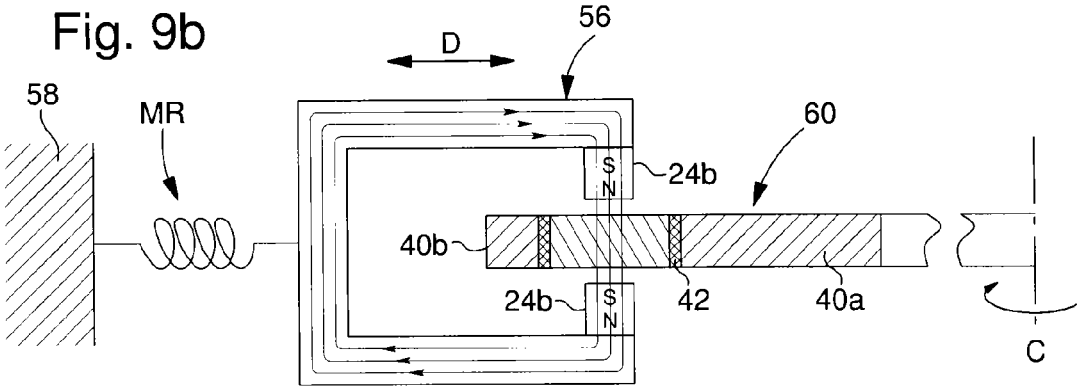
FIG. 9*b* is a variant of the configuration shown in FIG. 9*a* including two permanent magnets disposed facing the ferromagnetic path on each side of the rotor.

FIG. 9*b* is a variant of the configuration shown in FIG. 9*a* wherein conductive frame 56 includes two permanent magnets 24*a*, 24*b* disposed facing the ferromagnetic path 26 on each side of the rotor 22.

Figure 9C:
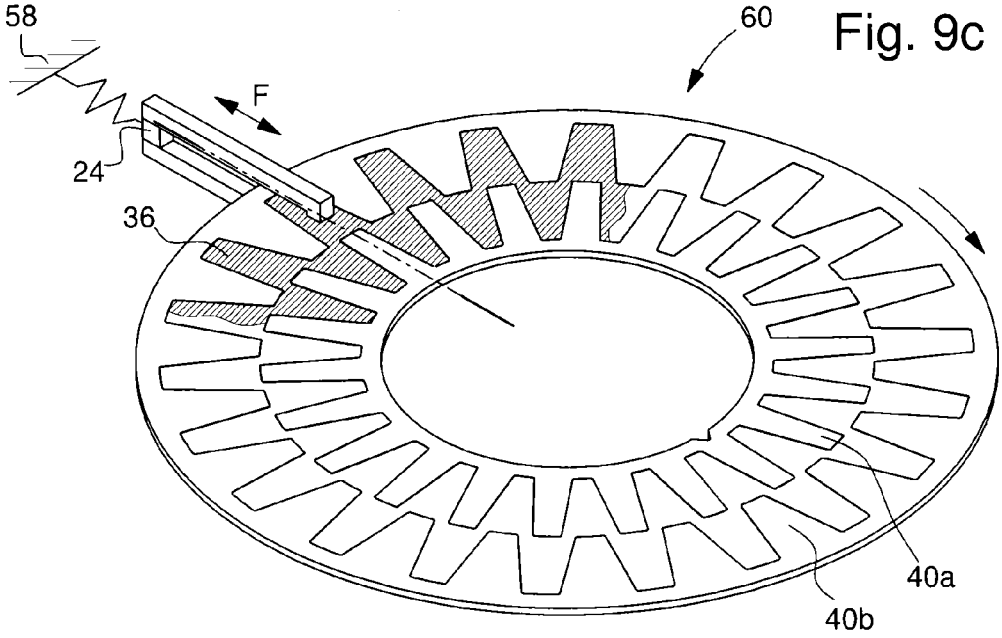
FIG. 9*c* shows a perspective view of a schematic example embodiment of the magnetic regulating device illustrated in FIGS. 9*a* and 9*b*.

FIG. 9*c* shows a perspective view of an example embodiment of the magnetic regulating device shown in FIGS. 9*a* and 9*b*.

Finally, it will be noted that the regulating device according to the present invention can easily be integrated without adaptation in a timepiece movement in place of the conventional resonator formed by the balance spring and the escapement.

What is claimed is:

1. A magnetic device to regulate the relative angular velocity of a wheel and of at least one magnetic dipole integral with an oscillating device, said wheel or said dipole being driven by a driving torque, said wheel including a periodic, ferromagnetic pole path which alternates according to a center angle and said at least one dipole being arranged to permit magnetic coupling with said ferromagnetic path and oscillation of said dipole at a natural frequency of an oscillating element during a relative motion of the wheel and of the magnetic dipole to regulate said relative angular velocity, wherein said wheel further includes an assembly to dissipate kinetic energy of said at least one dipole when the dipole moves away from said ferromagnetic path, and said assembly include non-ferromagnetic, electrically conductive sectors.

2. The regulating device according to claim 1, wherein said assembly are arranged adjacent to said ferromagnetic path on at least one of sides of said ferromagnetic path.

3. The regulating device according to claim 1, wherein said sectors extend substantially in a plane of said ferromagnetic path.

4. The regulating device according to claim 1, wherein non-ferromagnetic, electrically conductive sectors are disposed on both sides of said ferromagnetic path.

5. The regulating device according to claim 1, wherein said non-ferromagnetic, electrically conductive sectors are electrically insulated from said ferromagnetic path.

6. The regulating device according to claim 5, wherein electrical insulation is achieved by an air gap or galvanic assembly.

7. The regulating device according to claim 1, wherein the ferromagnetic path includes through slots extending substantially perpendicularly to a plane of the ferromagnetic path.

8. The regulating device according to claim 1, wherein the ferromagnetic path is formed by a concentric lamination of ferromagnetic material.

9. The regulating device according to claim 1, wherein the non-ferromagnetic electrically conductive sectors are made of a material chosen from a group including gold, silver, copper, aluminum, platinum, palladium, titanium and nickel.

10. The regulating device according to claim 1, wherein the ferromagnetic path is made of a material chosen from a group including soft iron, mu-metal and Supermalloy.

11. The regulating device according to claim 1, wherein said at least one dipole is a permanent magnet.

12. The regulating device according to claim 1, wherein said at least one magnetic dipole has a direction of magnetization perpendicular to a plane of the ferromagnetic path.

13. The regulating device according to claim 12, wherein said at least one magnetic dipole includes an open structure defining a closed magnetic circuit and an air gap in which the wheel can move perpendicularly to a direction of magnetic flux generated by said at least one magnetic dipole, free ends of said structure extending substantially facing said ferromagnetic path when said oscillating element is at rest.

14. The regulating device according to claim 13, wherein said wheel is driven in rotation by said driving torque and in that said oscillating element is integral with a fixed frame.

15. The regulating device according to claim 12, wherein said at least one magnetic dipole is integral with at least one arm, one of poles of said dipole extending substantially facing said ferromagnetic path when said oscillating element is at rest.

16. The regulating device according to claim 15, wherein said at least one arm is integral with a balanced rotor driven by said driving torque, and said at least one dipole is driven by the driving torque and said wheel is integral with a fixed frame.

17. The regulating device according to claim 1, wherein the ferromagnetic path is continuous.

18. The regulating device according to claim 1, wherein the ferromagnetic path is oriented perpendicularly to the axis of revolution of said wheel.

19. The regulating device according to claim 1, wherein said wheel includes an insulating substrate, and said ferromagnetic path and said non-ferromagnetic, electrically conductive sectors are arranged on at least one face of the insulating substrate.

20. A timepiece movement for a timepiece including a regulating device to regulate a relative angular velocity of a wheel and of at least one magnetic dipole integral with an oscillating device, said wheel or said dipole being driven by a driving torque, said wheel including a periodic, ferromagnetic pole path which alternates according to a center angle and said at least one dipole being arranged to permit magnetic coupling with said ferromagnetic path and oscillation of said dipole at a natural frequency of an oscillating element during a relative motion of the wheel and of the magnetic dipole to regulate said relative angular velocity, wherein said wheel further includes an assembly to dissipate kinetic energy of said at least one dipole when the dipole moves away from said ferromagnetic path, and said assembly include non-ferromagnetic, electrically conductive sectors.

21. A timepiece including a timepiece movement for a timepiece including a regulating device to regulate a relative angular velocity of a wheel and of at least one magnetic dipole integral with an oscillating device, said wheel or said dipole being driven by a driving torque, said wheel including a periodic, ferromagnetic pole path which alternates according to a center angle and said at least one dipole being arranged to permit magnetic coupling with said ferromagnetic path and oscillation of said dipole at a natural frequency of an oscillating element during a relative motion of the wheel and of the magnetic dipole to regulate said relative angular velocity, said device being wherein said wheel further includes an assembly to dissipate kinetic energy of said at least one dipole when the dipole moves away from said ferromagnetic path, and said assembly include non-ferromagnetic, electrically conductive sectors.

* * * * *